US006332484B1

(12) United States Patent
Stahlecker et al.

(10) Patent No.: US 6,332,484 B1
(45) Date of Patent: Dec. 25, 2001

(54) MACHINE INSTALLATION FOR FILLING CONTAINERS WITH CONTENTS

(75) Inventors: Werner Stahlecker, Göppingen; Robert Frost, Landshut, both of (DE)

(73) Assignee: Rudiger Haaga GmbH, Altoberndorf (DE)

( * ) Notice: Subject to any disclaimer, the term of this patent is extended or adjusted under 35 U.S.C. 154(b) by 0 days.

(21) Appl. No.: 09/564,578

(22) Filed: May 5, 2000

(30) Foreign Application Priority Data

May 7, 1999 (DE) ..... 199 21 274

(51) Int. Cl.[7] ..... B65B 43/42; B65C 3/00

(52) U.S. Cl. ..... 141/129; 141/91; 141/92; 141/134; 141/168; 141/170; 198/415

(58) Field of Search ..... 141/129, 134, 141/168, 170, 176, 89, 91, 92; 53/426, 267; 198/415

(56) References Cited

U.S. PATENT DOCUMENTS

| | | | | |
|---|---|---|---|---|
| 3,682,207 | * | 8/1972 | Rickard et al. | 141/98 |
| 4,207,286 | * | 6/1980 | Boucher | 422/21 |
| 5,129,212 | * | 7/1992 | Duffey et al. | 53/426 |
| 5,700,327 | * | 12/1997 | Babacz et al. | 134/1.1 |

FOREIGN PATENT DOCUMENTS

| | | |
|---|---|---|
| 44 08 301 | 9/1994 | (DE) . |
| 197 19 911 | 11/1998 | (DE) . |

* cited by examiner

*Primary Examiner*—Timothy L. Maust
(74) *Attorney, Agent, or Firm*—Crowell & Moring LLP

(57) ABSTRACT

In the case of a machine installation for sterilizing, filling and closing containers it is provided that the above named devices are arranged together in a station, which is, with regard to drive, independent of the mechanism for feeding and removing the containers. A plurality of such stations can be provided, which preferably comprise a plasma sterilizing reactor.

29 Claims, 2 Drawing Sheets

MACHINE INSTALLATION FOR FILLING CONTAINERS WITH CONTENTS

BACKGROUND AND SUMMARY OF THE INVENTION

This application claims the priority of German application 199 21 274.0, filed in Germany on May 7, 1999, the disclosure of which is expressly incorporated by reference herein.

The present invention relates to a machine installation for filling containers with contents, comprising, devices for feeding empty containers to be filled, devices for sterilizing the containers to be filled, devices for filling the containers, devices for closing the filled containers and devices for removing the closed containers from the machine.

Today there are two types of this kind of machine installation, which differ in their geometry, namely the so-called lineal filler and the so-called round filler. In the case of the lineal filler, for which the German published patent application 44 08 301 is mentioned as an example, the containers to be filled travel straight through the machine, in which the individual procedural steps are carried out in stations arranged downstream of one another. The lineal filler is, as a rule, more suited-to less high-powered tasks, and is provided with devices with which a definite number of containers, for example, six, can be simultaneously filled. All six containers are located at any time in the process in the same position. They are drawn in simultaneously and withdrawn simultaneously. The machine functions intermittently, in the present case, in batches of six. The typical performance rate of a linear filler lies at approximately 6,000 to 12,000 containers per hour. A plurality of machine installations can be set up, which, if coupled, can operate parallel to one another. If a continuously operating machine, for example, a washing machine, is placed upstream thereof, a back-up section is then necessary.

In the case of a round filler, for which German published patent application 197 19 911 is named as an example, the containers to be filled travel on a carousel in a circle. This circle is divided into sectors, in which certain procedural steps are carried out. The stations mounted at the periphery of the round filler move one after the other through the individual sectors. Thus the individual procedural steps are run through one after the other. The status of each station is given by the sector in which the station is located at any given time. Round fillers are manufactured for all levels of performance. At the highest level of performance, for example, approximately 20,000 to 30,000 bottles are filled per hour, or in the case of drinking cans, up to 120,000. The operation is continuous.

In the case of the lineal filler and also the round filler, a station, even a machine, is applied for each procedural step, for example a sterilizer, a filler and a closer. In the case of round fillers, entry and exit stars are additionally required. It is thus inevitable that, when one single machine breaks down, the entire installation is brought to a standstill.

It is an object of the present invention to avoid the latter mentioned disadvantage and to produce a machine installation for the filling of containers which installation, on the one hand with regard to performance capability or the installed performance, has the greatest possible leeway, and which machine installation stands for extreme reliability, i.e. meaning that if one machine breaks down, the entire machine installation does not come to a standstill.

This object has been achieved in accordance with the present invention in that the devices for sterilizing, for filling and for closing are arranged together in a station which is driven independently of the feeding and removing devices.

Sterilizing, filling and closing thus takes place together in one single station. This station comprises all the devices which are necessary for the above mentioned processes. Such a station having the necessary functioning elements, namely the sterilizer, the filler, the closer and in particular also the feed and removal devices, forms a module for aseptic cold filling. Due to the autarky or self sufficiency of the module in connection with its hermetical sealing from the environment, a machine installation of this kind makes much less demands on the production environment than the above mentioned installation types.

The central piece of each station is in an embodiment of the present invention a plasma sterilization reactor, to which devices for filling and closing the containers are arranged. Thus multifunctional stations are involved here, which differ from similar devices of the known installations.

A plurality of stations can be arranged parallel to one another to adapt to the required performance of the installation, which stations preferably function independently of one another. Any desired number of stations can be assembled. Each single station fetches, as required, a container, sterilizes it, fills it and closes it, and subsequently ejects it again. A plurality of such stations can be active simultaneously. A sufficient feed and receiving capacity need only be provided. Every performance level can be realized in that the corresponding number of identical modules are provided. The performance of an installation can be increased by applying further modules as required. A high performance installation can, in the same way, be divided into two installations having a middle performance rate. A new installation could be so flexibly designed that performance adaptations would be possible within a very short time. The operational reliability of such an installation is at an optimum, as, if one station has an operational fault or breaks down totally, the remaining stations continue to operate unimpaired. Even maintenance would not disrupt operation if the individual modules are maintenanced successively. If the container changes its form, the part of the installation which has not yet been retrofitted can continue to produce. On the other hand, production with a new form can begin even if the entire machine has not yet been retrofitted.

Even in the case of a plurality of stations operating in an autarkik or self sufficient way, it can, however, be advantageous, especially in the case of lower performance installations, that a plurality of stations are connected to a joint control device and operate coordinately. For example, a high frequency generator, which is necessary for the plasma sterilization reactor, can be used jointly for a plurality of stations, so that the individual high frequency generators attain the highest possible operating time and thus the highest utilization ratio. The same applies to an evacuation system, as the plasma sterilization reactors are, as a rule, connected to a vacuum device.

In a further advantageous arrangement of preferred embodiments of the present invention, a feed switch connected with the feeding devices and a delivery switch connected with the removing devices are arranged at each station. The devices for feeding the containers serve also as a back-up section. One draw-in and one ejection establishes the connection to the feed switch and to the delivery switch respectively.

It is purposeful according to preferred embodiments of the invention when joint installation devices are arranged at the stations. These include such devices as the supply lines for supplying the plasma sterilization reactors with process gas or sterile gas as well as the devices for evacuating, or compressed air lines for activating pneumatic valves and drives.

A central drive shaft can be provided for driving the driving elements of the individual stations, which drive shaft drives an internal module gearing. The individual stations, however, remain totally independent drive-wise, as the individual gearings can be coupled and de-coupled from the drive shaft.

The controlling of the installation takes place on two hierarchical levels. Each station has its own control device, which ensures the local procedural steps. The control devices communicate in turn with the joint control device mentioned above, which ensures, for example, that in response to a demand from a station, that station is immediately connected to an available high frequency generator, so that the plasma phase can begin. After the plasma phase has ended, the joint control device makes the now free high frequency generator available to another station.

Other advantages, features, and details of the invention will be found in the description below in which a number of embodiments of the invention are described in detail with reference to the drawings. The features referred to in the claims and the specification may be important to the invention individually or in any combination.

DETAILED DESCRIPTION OF THE DRAWINGS

Figure 1:
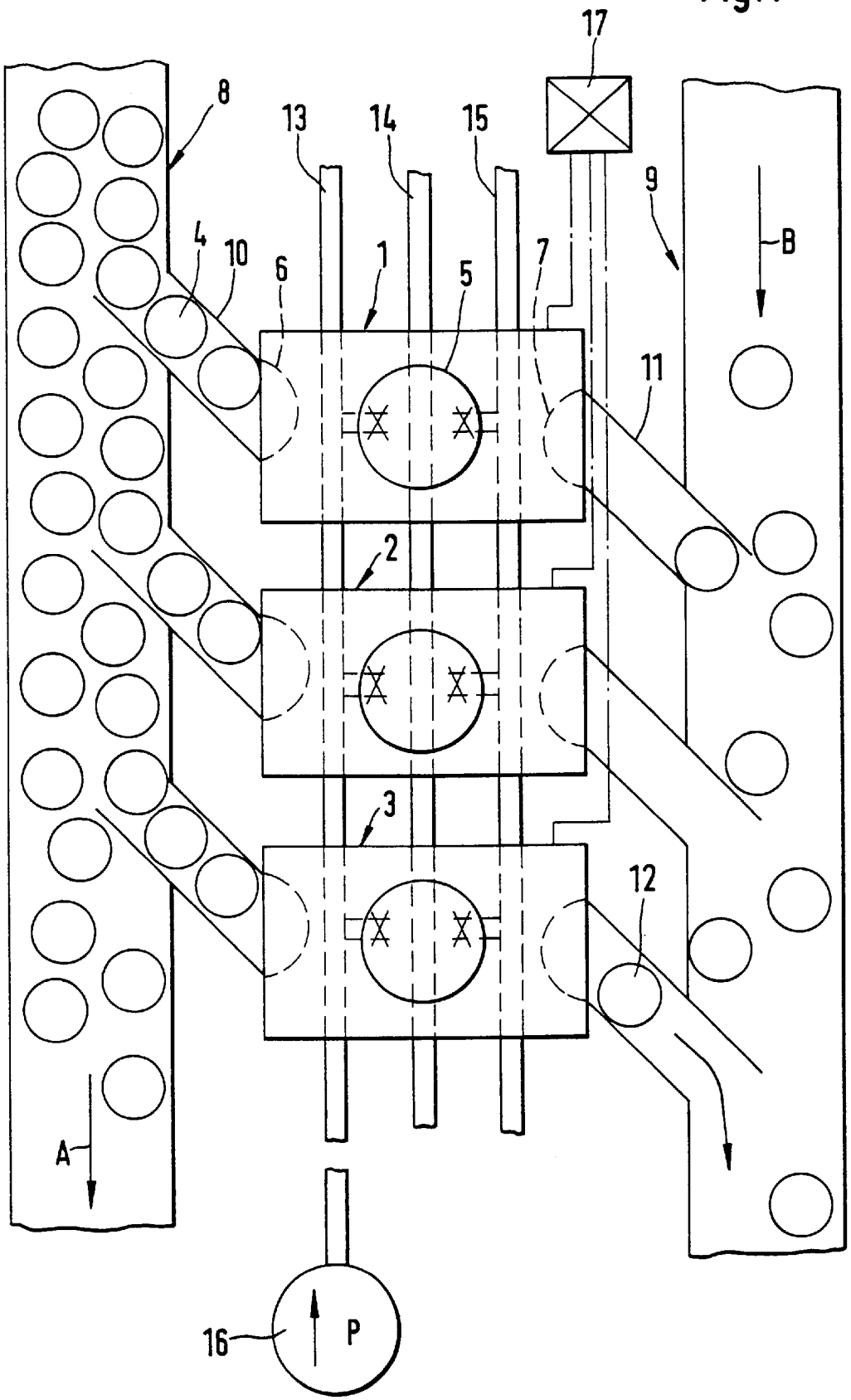
FIG. 1 is a top schematic view of a machine installation for filling containers with contents, constructed according to a preferred embodiment of the invention.

In the installation according to FIG. 1 three stations 1,2 and 3 are shown. A plurality of such further, identical stations can, of course, be present. Every required level of performance can be realized by the number of stations 1,2 and 3. Each of the stations 1,2 and 3 comprise, as described in more detail below with the aid of FIG. 2, a plurality of functions, which serve in particular the sterilization, the filling and the closing of containers 4. The individual stations 1,2 and 3 are totally independent drive-wise. The stations 1,2 and 3 each comprise in particular a plasma sterilization reactor 5, which is described below in closer detail with the aid of FIG. 2.

Each station 1,2 and 3 comprises, in addition to the indicated devices, a draw-in 6 for the containers 4 to be processed as well as an ejector 7 for the completed containers 12. Each station 1,2 and 3 forms, with the devices for sterilizing, filling and closing and the draw-in 6 and ejector 7, a module for aseptic cold filling.

Devices 8 for feeding the containers 4 to be filled are guided past the stations 1,2 and 3 as well as past further stations (not shown) in feed direction A. These devices 8 serve also as back-up sections, from which the individual stations 1,2 and 3 can take a container 4 as required.

In delivery direction B, devices 9 for removing the filled and closed containers 12 are guided past the individual stations 1,2 and 3. Containers 4 are each fed to a respective draw-in 6 of the individual stations 1,2 and 3 by means of a draw-in switch 10; after being filled and closed, the containers 12 reach the removing devices 9 by means of an ejector switch 11.

Eventual elimination of containers 12 during procedural faults must be guaranteed. Either each station 1,2,3 . . . must have its own device for eliminating faulty containers 12, which is controlled at the local level, or faulty containers 12 must be indicated, so that they can be eliminated by means of a joint control device 17.

In FIG. 1, supply devices 13,14 and 14 are indicated, which are described below and which involve supply lines for supplying the plasma sterilization reactors 5 with process gas and sterile gas and so on. The individual stations 1,2 and 3 are advantageously connected to a joint vacuum pump 16. The same may apply to a feed line for the filling contents. The individual supply devices 13,14 and 15 can be activated by means of individual valves by the respective autark stations 1,2 and 3.

In particular in the case of smaller installations, a joint control device 17 may be arranged for the individual stations 1,2 and 3, which device 17 coordinates the process. Thus the utilization ratio of devices, which would otherwise not operate to capacity, can be optimized. This applies in particular to the high frequency generators, which are arranged for the plasma sterilization reactors 5 in a way to be described with the aid of FIG. 2.

A machine installation with autark stations 1,2 and 3 according to the present invention has a maximum operational reliability, because even if one of the modules has an operational fault, or even if it breaks down altogether, the rest of the installation continues to operate unimpaired. Furthermore, as already mentioned, a possible change in the form of the containers 4 is very flexible. It is sufficient when the individual stations 1,2 and 3 are hermetically sealed against the environment, while no increased demands are made on any of the other remaining devices.

Figure 2:
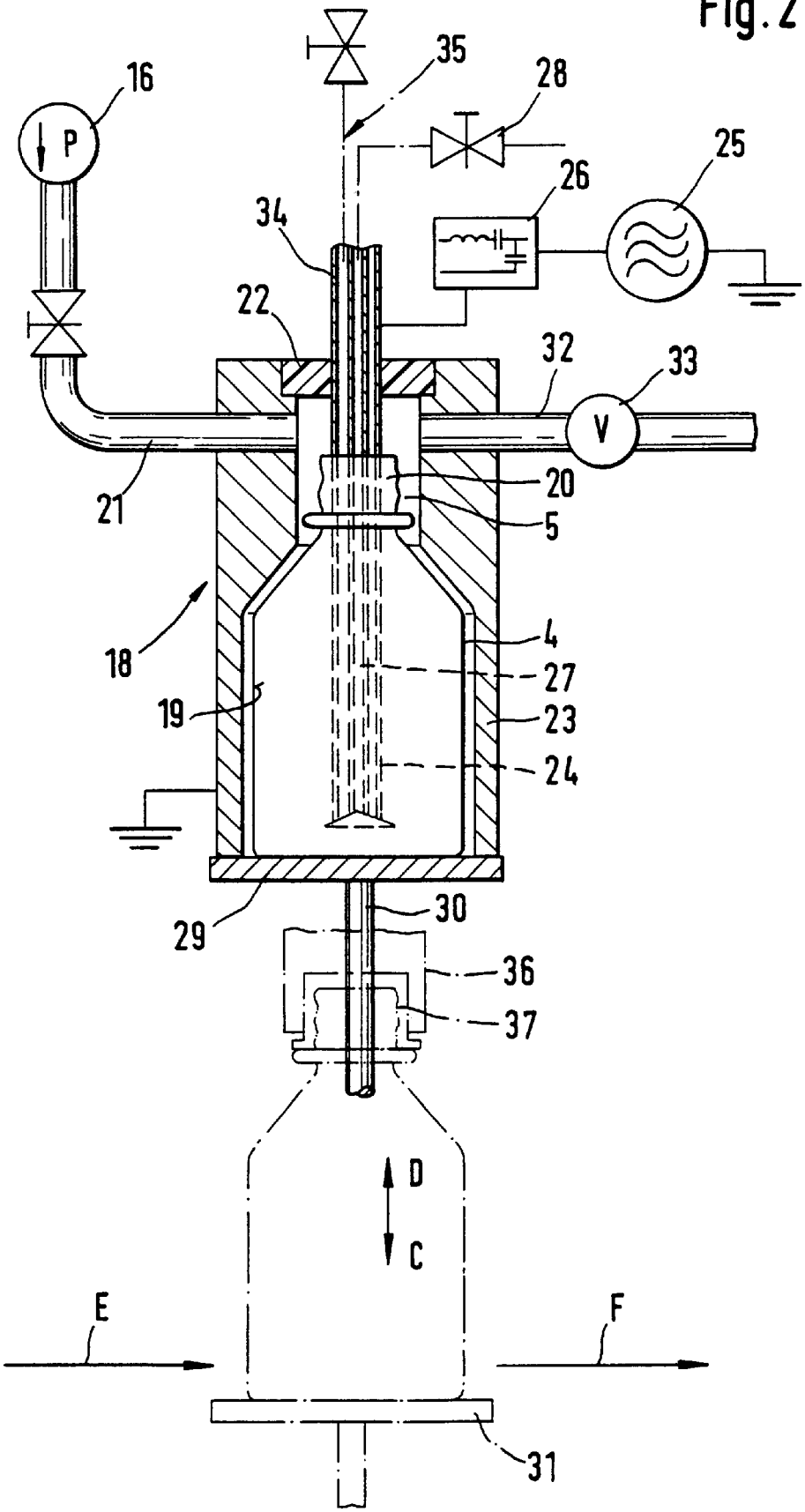
FIG. 2 is an axial sectional view of a plasma sterilizing reactor of the machine installation of FIG. 1, comprising devices arranged thereto for filling and closing a container.

Of the stations 1,2 and 3, essentially the devices 18 for sterilizing are disclosed in FIG. 2. They serve the sterilization of the containers 4 by means of a low pressure plasma and by means thereof at low temperatures. In the case of these containers 4, the inner surfaces 19 in particular are made free of bacteria. Of the outer surfaces, in contrast, only those need be sterilized which are located in the area of a filling opening 20. In order to be sterilized, a container 4 is taken up in an evacuable reactor 5, which is connected to a vacuum pump 16. By means of a suction tube 21 which runs into the area of the filling opening 20, the reactor 5 together with the container 4 is evacuated. Each station 1,2 or 3 treats only one container 4 at a time.

In order to generate the plasma, two electrodes 23 and 24 are provided which are arranged coaxially to one another and which are insulated against one another by means of an insulation 22. The electrode 23 is the outer electrode and electrode 24 is the inner electrode. The outer electrode 23 is earthed or grounded and formed in such a way that it forms a chamber during operation, which chamber takes up a container 4 and surrounds it closely with a wall. This enables a vacuum to be formed in the inside of the container 4 as well as outside of the container 4, so that the container 4 does not need to be form stable. The inner electrode 24 can be guided into the filling opening 20 and reaches to close proximity to the container bottom.

A high frequency generator 25 serves to generate the alternating voltage, which generator 25 has a performance with a permitted industrial frequency, for example 13.56 or 27.12 MHz. The power is capacitively sourced by an adapter network via the inner electrode 24. Due to the narrow gap between the wall of the outer electrode 23 and the outer contour of the container 4, the plasma is essentially only ignited in the inside of the container 4, so that essentially also only its inner surfaces 19 are sterilized.

The inner electrode 24 comprises a feed line 27 for a process gas to be ionized. The process gas enters the container 4 by means of a valve 28. The pressure can be checked by a pressure gaging device (not shown). The most suited plasma discharge pressure is dependent on the type of gas and can be in the range of between 0.1 Pa and several hundred Pa. A particularly suitable process gas is, for example, hydrogen peroxide, but basically other gases can also be used.

When the reactor 5 is closed, the container 4 stands with its container bottom on the bottom 29 of the reactor 5. The bottom 29 is disposed on a lifting rod 30 movable according to the directions of motion C and D, so that the reactor 5 can be opened and closed for permitting the container 4 in and out. The lowered position of the bottom 29 is denoted by a dot-dash line 31.

A supply line 32 for a sterile flooding gas after sterilization runs into the area of the filling opening 20. The supply line 32 comprises a valve 33.

Because the supply line 27 for the process gas is arranged in the inside of the inner electrode 24, the inside of the container 4 can be flooded easily and quickly with the process gas, whereby at the same time, rest air is displaced. This can take place on the level of the process pressure, so that it is not necessary to evacuate the reactor 5 below the discharge pressure.

The inner electrode 24 can serve also as an additional filling tube 34, which is thus then a component part of the device 35 for filling. Here a hollow valve lifter can be used for feeding the process gas, while the outer ring-shaped cross section surface is then available for the filling contents.

The course of the process runs as follows:

First a container 4, standing on the bottom 29 of the reactor 5, is pushed upwards. The bottom 29 is hereby pushed against the outer electrode 23 and the reactor 5 is closed by means of a seal.

The reactor 5, together with the container 4, is subsequently evacuated by means of the vacuum pump 16, namely only up to the point of plasma discharge pressure. In this phase, the reactor 5 is only filled with rest air.

Now process gas is fed through the supply line 27 located in the inside of the inner electrode 24, whereby the rest air is displaced from below upwards out of the container 4 and is sectioned off in the head area of the reactor 5. This process gas flow can, if required, continue to be fed at a reduced rate even after the subsequent plasma ignition until the end of the plasma phase. By means of the flow during the plasma phase, it is ensured in a technically simple way that the desired conditions really do prevail and that the maximum process gas concentration in the inside of the container 4 is provided.

After the plasma sterilization has been completed, and after the flow of the process gas has been switched off, sterile gas is flooded, for example with sterile air or sterile inert gas. Nitrogen, for example, would be a preferred gas. The flood gas is fed by means of a supply line 32 into the head room of the reactor 5. If hydrogen peroxide is used as a process gas, then essentially only water and molecular oxygen remain after the plasma is switched off.

When the container 4 is filled in the reactor 5, foaming of the filling contents can be reduced or completely eliminated by means of flooding beforehand with nitrogen at a pressure of possibly over one bar, that is by means of a certain pressure with sterile nitrogen, which permits quicker filling.

Devices 36 for filling the container 4 are indicated below the reactor 5 by means of a dot-dash line. These devices 36 are an option to the filling device 35 and tube 34 described above. As soon as the container 4 is pulled downwards out of the reactor 5, the container 4 can be closed by means of a seal 37. The container 4 then forms the filled and closed container 12.

In FIG. 2, the direction E for the draw-in 6 of containers 4 to be filled and the direction F for the ejector 7 of filled containers 12 is indicated. The draw-in 6 and the ejector 7 complete the respective stations 1,2 or 3 to the described module.

The individual stations 1,2 and 3 or the modules can, as they are autark (self-sufficient) drive-wise, operate independently, without being synchronized with each other. They fetch, as required, a container 4, sterilize it, fill it and close it and then eject it. Any desired number of modules can be mounted and be simultaneously active. By applying the relevant number of modules, all performance levels, can, as already mentioned, be realized as required.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A machine installation for filling containers with contents, comprising:

means for feeding empty containers to be filled, means for sterilizing the containers to be filled, means for filling the containers, means for closing the filled containers, and means for removing the closed containers from the machine, wherein the means for sterilizing, the means for filling and the means for closing are jointly arranged in a station driven independently from the means for feeding and the means for removing, wherein a draw-in switch connected to the means for feeding and an ejector switch connected to the means for removing are arranged at the station.

2. An installation according to claim 1, wherein the means for sterilizing comprise a plasma sterilization reactor.

3. An installation according to claim 1, wherein a plurality of stations arranged parallel to one another are provided.

4. An installation according to claim 2, wherein a plurality of stations arranged parallel to one another are provided.

5. An installation according to claim 3, wherein a plurality of stations are connected to a joint control device.

6. An installation according to claim 4, wherein a plurality of stations are connected to a joint control device.

7. An installation according to claim 3, wherein joint installation means are arranged at the stations for jointly supplying a plurality of said stations with at least one of sterile gas, process gas, and container filling material.

8. An installation according to claim 5, wherein joint installation means are arranged at the stations for jointly supplying a plurality of said stations with at least one of sterile gas, process gas, and container filling material.

9. An installation according to claim 7, wherein said joint installation means include a supply line for container filling material.

10. An installation according to claim 7, wherein said joint installation means include a supply line for process gas.

11. A machine installation according to claim 1, wherein a plurality of said stations are provided, and wherein each of said stations is provided with said draw-in switch and ejector switch.

12. A machine installation for filling containers with contents at a plurality of filling stations, comprising:

container feeders, operable to supply empty containers to respective filling stations, container sterilizer assemblies at respective filling stations, container filler devices at respective filling stations, container closing device at respective filling stations, and container removers operable to remove filled and closed containers from the respective fillings stations, wherein the sterilizer assemblies, filler devices, and closing devices are jointly arranged at respective filling stations and are operable independently of the container feeders and removers thereby facilitating simultaneous and independent operation of the respective filling stations, wherein said container feeders are supplied by a common conveyor traveling past the plurality of said filling stations, wherein said container removers are connected with a common conveyor traveling past the plurality of said filling stations.

13. A machine installation according to claim 12, wherein the sterilizer assemblies include respective plasma sterilization reactors.

14. A machine installation for filling containers with contents, comprising:

means for feeding empty containers to be filled, means for sterilizing the containers to be filled, means for filling the containers, means for closing the filled containers and means for removing the closed containers from the machine, wherein the means for sterilizing, the means for filling and the means for closing are jointly arranged in a station driven independently from the means for feeding and the means for removing, wherein a plurality of stations arranged parallel to one another are provided, and wherein joint installation means are arranged at the stations for supplying a plurality of said stations with at least one of sterile gas, process gas, and container filling material.

15. A machine installation according to claim 14, wherein said joint installation means include a supply line for container filling material.

16. A machine installation according to claim 14, wherein said joint installation means include a supply line for process gas.

17. A machine installation comprising:

a plurality of module stations which each have a container sterilizer, a container filler and a container closer, a container feeder transport device operable to feed empty containers to respective ones of the module stations, and a container removal transport device operable to remove filled containers from respective ones of the module stations, wherein the container feeder transport device is operable to store a plurality of empty containers, and wherein the container feeder and container removal transport devices are drivingly controlled independently of drivers for the respective module stations.

18. A machine installation according to claim 17, wherein each station module includes a feed control switch operable to selectively connect the container feeder transport device with the respective module station.

19. A machine installation according to claim 18, wherein each station module includes a removal control switch operable to selectively connect the respective module station with the container removal transport device.

20. A machine installation according to claim 17, wherein each station module includes a removal control switch operable to selectively connect the respective module station with the container removal transport device.

21. A machine installation according to claim 17, wherein each sterilizer comprises a plasma sterilization reactor.

22. A machine installation according to claim 18, wherein each sterilizer comprises a plasma sterilization reactor.

23. A machine installation according to claim 19, wherein each sterilizer comprises a plasma sterilization reactor.

24. A machine installation according to claim 20, wherein each sterilizer comprises a plasma sterilization reactor.

25. An installation according to claim 21, wherein joint installation means are arranged at the stations for jointly supplying a plurality of said stations with at least one of sterile gas, process gas, and container filling material.

26. An installation according to claim 25, wherein said joint installation means include a supply line for container filling material.

27. An installation according to claim 25, wherein said joint installation means include a supply line for process gas.

28. An installation according to claim 17, wherein each module station is configured to sequentially sterilize and fill one container at a time.

29. An installation according to claim 19, wherein each module station is configured to sequentially sterilize and fill one container at a time.

* * * * *